United States Patent [19]

Guynup

[11] 4,291,601

[45] Sep. 29, 1981

[54] SHAKE RESAW FEED SYSTEM

[76] Inventor: William J. Guynup, 3106 NW. Harrison, Corvallis, Oreg. 97330

[21] Appl. No.: 74,056

[22] Filed: Sep. 10, 1979

[51] Int. Cl.[3] ..... B27M 3/02

[52] U.S. Cl. ..... 83/415; 83/418; 83/420; 83/422; 83/435; 83/435.2; 83/871; 83/920; 144/13

[58] Field of Search ..... 83/415, 418, 420, 422, 83/435, 435.2, 920, 871; 144/13

[56] References Cited

U.S. PATENT DOCUMENTS

| | | | |
|---|---|---|---|
| 1,593,800 | 7/1926 | King . | |
| 1,842,419 | 1/1932 | Morris | 83/835.2 |
| 1,895,016 | 1/1933 | Whiting | 83/415 |
| 1,976,171 | 10/1934 | Hutchings . | |
| 2,634,768 | 4/1953 | Hight | 83/435 X |
| 3,171,450 | 3/1965 | Boullet . | |
| 3,314,455 | 4/1967 | Taylor | 83/422 X |
| 3,407,855 | 10/1968 | Ritchie . | |
| 3,927,706 | 12/1975 | Davey . | |
| 4,089,355 | 5/1978 | Dueck | 144/13 X |

*Primary Examiner*—Donald R. Schran

*Attorney, Agent, or Firm*—Klarquist, Sparkman, Campbell, Leigh, Whinston & Dellett

[57] ABSTRACT

A shake resaw feed system is used with a band saw for lengthwise sawing of tapered wood shingles from shake blanks or slabs. The feed system includes an endless chain conveyor having flights or push paddles spaced equidistantly apart along the chain for pushing each slab longitudinally toward the blade of the band saw. Along the conveyor are guides including a fence on one side of the conveyor and flexible fingers on the other side of the conveyor for urging the slabs against the fence as they proceed along the conveyor. The fence is automatically shifted laterally during sawing of the slab to produce a tapered cut through the slab. The system also includes apparatus for sensing the thickness of the slabs and for automatically repositioning the fence laterally to equalize the thickness of the shingles cut from the slab. Downstream of the band saw is a second conveyor in the form of drag wheels for grasping the pair of shingles being cut from each slab as they pass the blade, and for pulling the slab through the blade. The drag wheels are laterally movable as a unit and are individually separable to accommodate shakes of different thicknesses.

20 Claims, 7 Drawing Figures

SHAKE RESAW FEED SYSTEM

BACKGROUND OF THE INVENTION

The present invention relates generally to shingle cutting machines, and more particularly to a feed system that can be used in combination with a band saw or the like for the lengthwise cutting of shake slabs to produce resawn tapered shake shingles.

In the past, shake-type shingles were formed by manually splitting slabs of wood along their grain. Apparatus for mechanizing this procedure is disclosed in U.S. Pat. No. 3,407,855 to Richey. To enable these shake shingles to overlap one another evenly, a draw knife was used to remove irregularities of the natural split surfaces and to impart a taper to the shingle.

In U.S. Pat. No. 1,593,800, King described an improved method of making tapered shingles by sawing the slabs diagonally along their thickness to form two tapered shingles simultaneously. Originally, King's method was performed manually, but the method has since been automated to some extent by the use of apparatus described in U.S. Patents to Hutchings, U.S. Pat. No. 1,976,171, and Boullet, U.S. Pat. No. 3,171,450. In each of these designs, the slabs are sawn diagonally widthwise by a band saw, the slabs being oriented so that one of their long, narrow side faces, rather than an end face, is directed toward the blade of the saw.

Because they cannot cut slabs lengthwise to produce tapered shakes, the utility of these designs is limited by the physical configuration of the slabs. The slab can have uneven or corrugated surfaces, can be of variable thickness, and can be curved or warped along their length. Although the design of Boullet is calculated to accommodate slabs of varying thickness, it is impractical for cutting uneven surfaced, twisted, warped or curved slabs. Two shingles cut from such a slab can have substantially different thicknesses and individual shingles are often unevenly tapered along their length. Many such shingles are unusable and must be discarded.

Consequently, the practice of manually supporting and feeding slabs lengthwise into a band saw continues to be widely used. Obviously, this method is not only slow and tedious, it is a very expensive and dangerous way to produce shingles.

It would be preferable to have an automatic shake slab feeding apparatus for use with a band saw that would produce accurately tapered shake shingles from uneven-surfaced slabs that can be of varied thickness and can be curved, twisted or warped along their length.

SUMMARY OF THE INVENTION

Accordingly, it is a primary object of the invention to automatically cut evenly-tapered shingles from slabs that are warped, unevenly-surfaced, twisted or curved along their lengths.

Another primary object of the invention is to cut a pair of evenly-tapered complementary shingles or shakes of substantially similar thickness from slabs of varying thicknesses.

Yet another object of the invention is to automatically adjust the feed system to cut shingles or shakes as aforementioned despite variations in both shape and thickness.

A shake resaw feed system according to the invention is designed to be used with a band saw having a vertical or horizontal blade. The system includes infeed conveyor means for conveying a shake slab lengthwise toward and through the blade of the saw. The slab is positioned on the conveyor so that the cutting line of the blade passes between the broad faces of the slab; an end face, rather than a side face of the slab, being directed toward the blade.

Guide means guide the slab along the conveyor and progressively shift the slab laterally of the conveyor as it moves through the blade, causing the blade to cut at continuously changing lateral positions between the broad faces of the slab.

The guide means are synchronized with the conveyor so that the blade begins cutting at the aforementioned end face of the slab at a lateral position offset toward one of the broad faces. The guide means progressively shifts the slab laterally to saw diagonally through its length, as the slab moves along the conveyor until the blade finishes cutting the slab at the opposite end face at a lateral position near the opposite broad face. Two complementary tapered shingles result.

The feed system can include thickness sensing and adjustment means for automatically compensating for lengthwise corrugation, curvature or warping of the slabs and for variations in thickness of the slabs. The sensing means is adapted for sensing the distance of one broad face of the slab from a reference position, such as a wall defining one side of the guiding means. The thickness adjustment means is responsive to the sensing means for automatically repositioning the slab laterally of the conveyor means to compensate for the aforementioned variations.

The thickness sensing means, which can be a sensing arm urged against one of the broad sides of the slab, can also be disconnected so that the feed system can be used to repetitively feed blocks of wood to the band saw for cutting multiple tapered boards therefrom.

An outfeed conveyor means is positioned on the downstream side of the band saw blade to receive the shingles as they pass through the saw blade. The outfeed conveyor means takes over where the infeed conveyor means leaves off so that the slab is under control of a conveyor throughout the sawing process. The outfeed conveyor means is automatically adjustable laterally of the blade so that it can receive shingles whereever they are positioned by the guide means and the thickness adjustment means.

These and other objects, features and advantages of the invention will become more apparent from the following detailed description of a preferred embodiment which proceeds with reference to the drawings.

DETAILED DESCRIPTION OF A PREFERRED EMBODIMENT

General Arrangement

Figure 4:
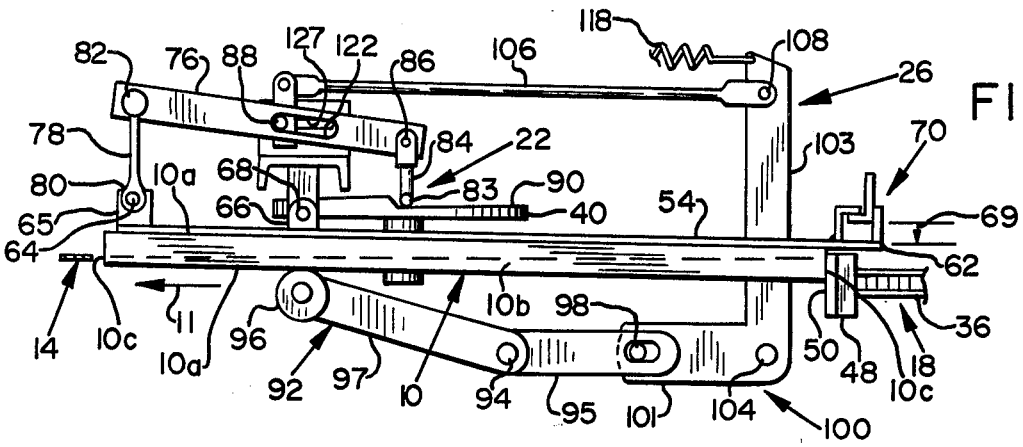
FIGS. 4, 5 and 6 are top plan schematic views showing operation of the taper cutting and thickness adjustment assemblies of the apparatus of FIG. 1.
Figure 5:
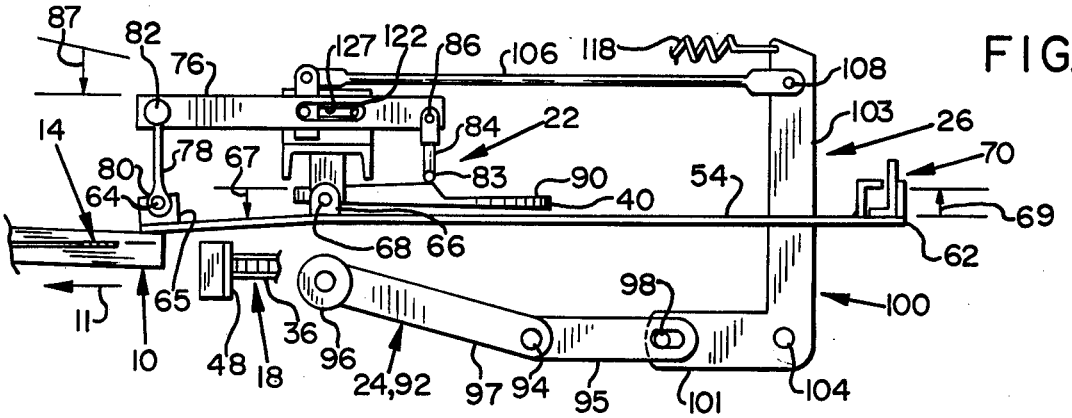
Figure 6:
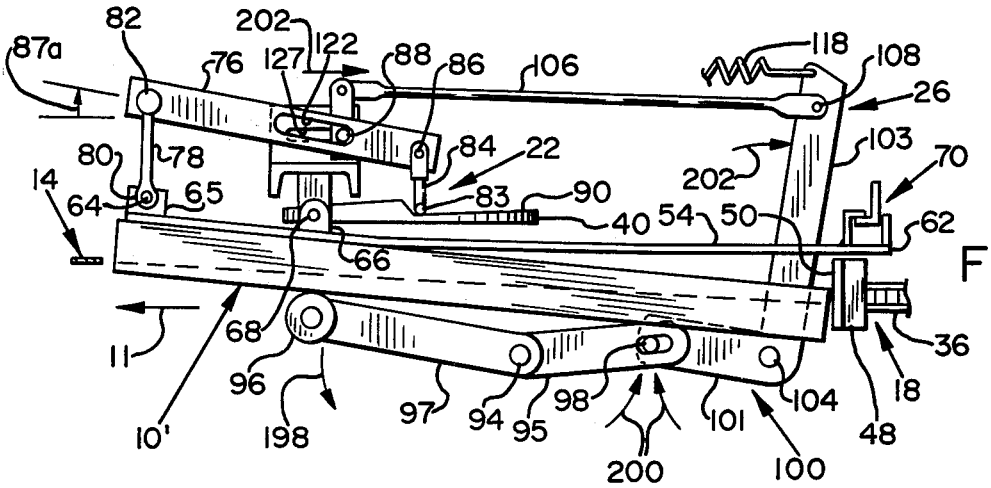
Figure 7:
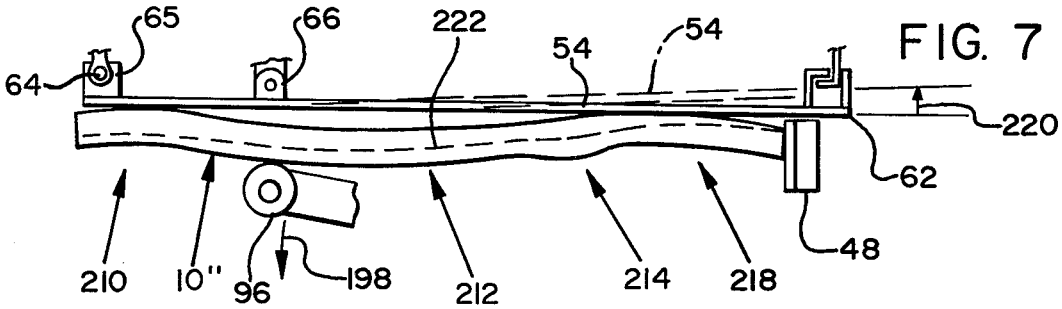
FIG. 7 is a top plan schematic view of portions of the assemblies of FIGS. 4–6 with a warped slab positioned on the conveyor.

The preferred embodiment of the shake resaw feed system is designed to feed shake slabs 10, two feet in length and approximately one inch thick, lengthwise through a band saw, as indicated by arrow 11, for cutting the slab along a lengthwise diagonal to produce two resawn, tapered shake shingles (not shown). Referring to FIGS. 4–7 a slab 10 has a generally rectangular configuration, but can be irregularly shaped as well. It has two opposite broad faces 10*a* extending along the two foot length of the slab and spanning its width, which can vary between about four and fourteen inches. Two opposite side faces 10*b* span the thickness of the slab and define the lengthwise edges of the broad faces. Two opposite end faces 10*c* define the narrow dimensions of the broad faces and the side faces and are generally normal thereto. Such slabs can vary in thickness from one slab to another, as shown in FIGS. 4 and 6. Because the slab is split along the grain of the wood its broad faces 10*a* frequently have a corrugated or rippled surface characterized by ridges and valleys extending lengthwise along the broad faces. Because of warping and the presence of knots in the wood, some slabs can also be of varying thicknesses or curved along their broad faces, as shown in FIG. 7.

Figures 1, 2:
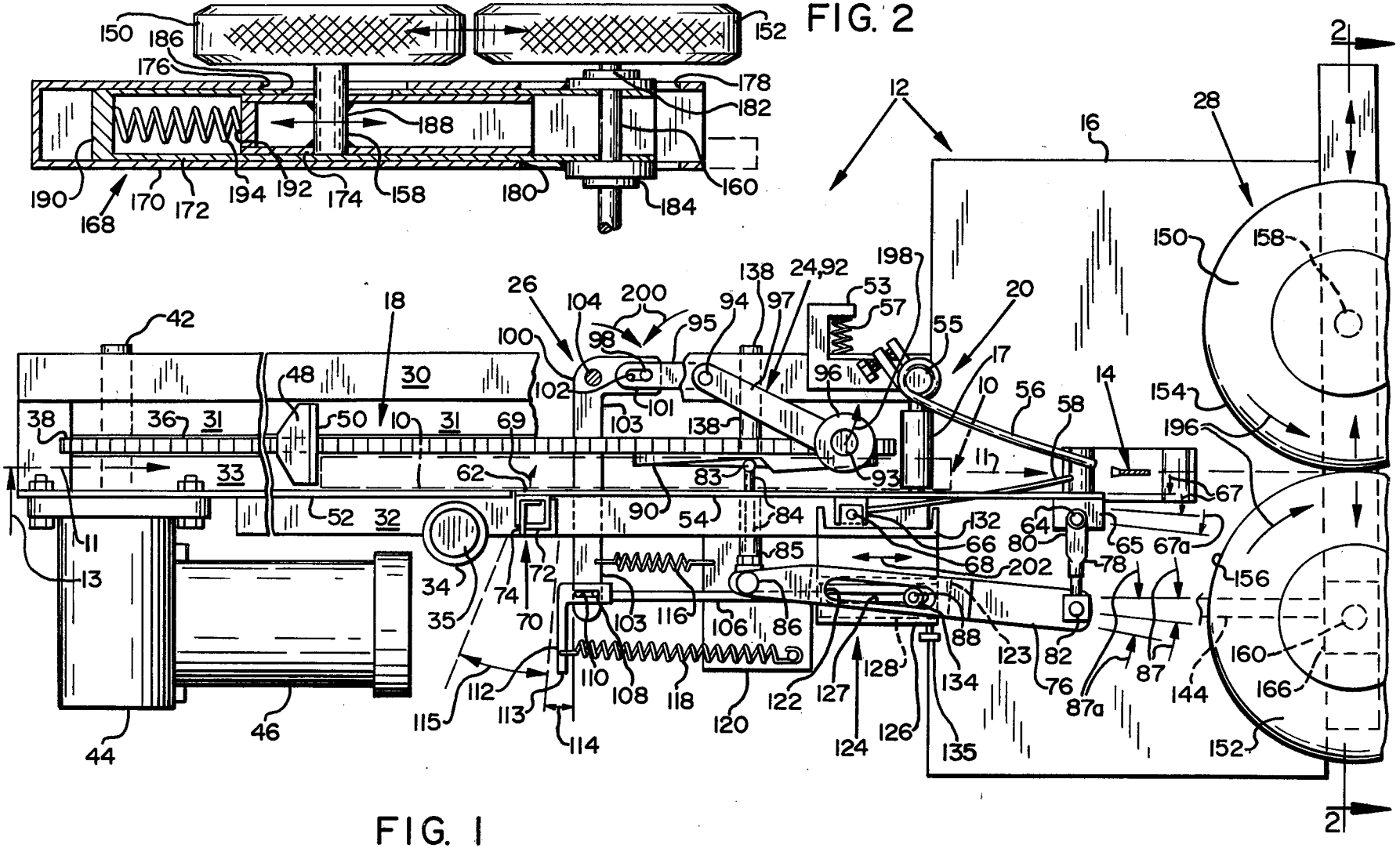
FIG. 1 is a top plan view of a shake resaw feed system according to the invention, portions of the conveyor frame rails and bottom plates being cut away to show underlying details of construction. A shake slab is depicted in phantom lines in position on the conveyor for feeding lengthwise to the band saw.
FIG. 2 is a cross sectional view of the drag wheel conveyor taken along line 2—2 in FIG. 1.
Figure 3:
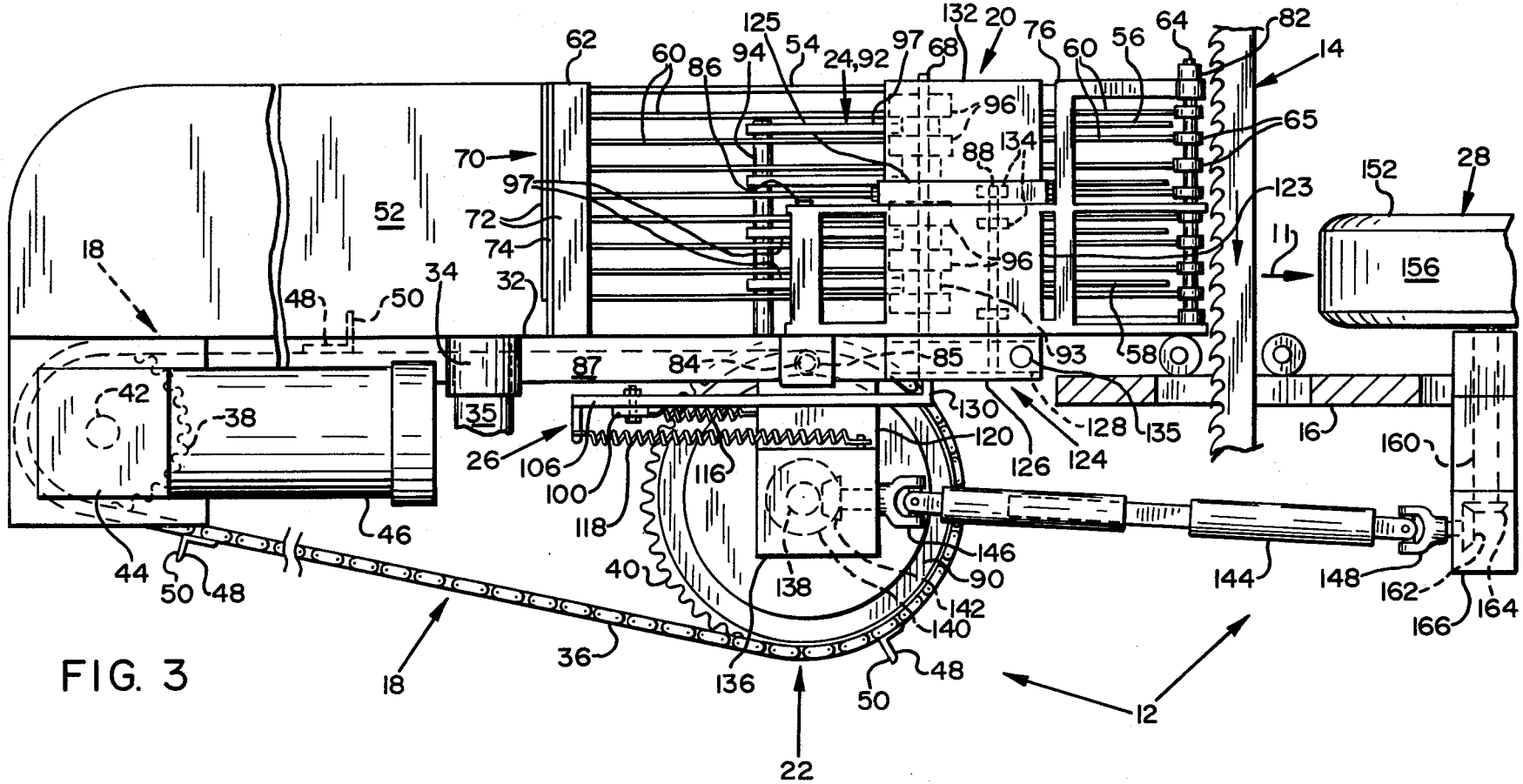
FIG. 3 is a side elevational view of the apparatus of FIG. 1 with portions of the band saw platform cut away to show details of construction.

Referring to FIGS. 1, 2 and 3, a shake mill includes a shake resaw feed system 12 bolted to the table of a vertically-positioned band saw, of which only saw table 16 and blade 14 are shown in the drawings. Upstream of blade 14 are infeed conveyor means 18, guide means 20, synchronization means 22 (FIG. 3), sensing means 24 and thickness adjustment means 26. Downstream of the blade is an outfeed conveyor means 28. The system can also be used with a horizontally-positioned band saw by rotating the system 90° clockwise about the axis of the infeed conveyor.

The upstream elements of the system are arranged on a frame which includes two parallel interconnected frame rails 30, 32 positioned along opposite sides of the conveyor means. Lengthwise extending conveyor bottom plates 31, 33 are connected to the frame rails on each side of the conveyor means. The frame rails are angle members connected to a vertical cylindrical column 35 forming a part of the supporting frame work (not shown) of the system by a pivotable sleeve 34. The sleeve allows the system to be rotated in a horizontal plane away from the saw table 16 for servicing of the saw blade 14.

The infeed conveyor means is angularly offset at a very small angle in the direction of arrow 13 from the saw line 11 of the blade. In one example, the angular deviation is about $\frac{5}{8}''$ over a distance of two feet from the blade, or about 2°.

Referring to FIGS. 1 and 3, the conveyor means 18 includes a roller 17 and an endless roller chain 36 circulating in a conveyor path between the frame rails laterally offset from the saw line 11 of the band saw blade 14. The chain is connected for rotation around a drive sprocket 38 positioned remotely from the band saw blade, and a driven sprocket 40 positioned near the blade. The drive sprocket is mounted for rotation on the output shaft 42 of a speed reduction gear box 44 driven by motor 46. The preferred motor for this application is an alternating current electrical motor having variable speed and torque characteristics and provided with an automatic brake. Alternatively, a hydraulic drive motor can be used.

Three push paddles or flights 48 are equally spaced along the length of chain 36 to provide means for pushing slabs 10 toward the blade 14 as the chain circulates along the conveyor path. Each flight has a planar front face 50 that is normal to the direction of movement of the chain so that the end faces of the slabs can be easily moved laterally across such faces.

Taper Cutting Assembly

The guide means 20 include wall means extending along the conveyor path and deflection means for progressively deflecting laterally the portion of the wall means nearest the band saw blade 14. The wall means includes a vertical back plate 52 connected to the top of a portion of frame rail 32 remote from the band saw blade. The wall means also includes a vertical fence 54 pivotally connected to frame rail 32 at a position intermediate the back plate and the band saw blade.

The wall means further includes two vertical arrays of flexible wire fingers 56, 58 positioned near the band saw blade on opposite sides of the conveyor path. Such fingers are directed at an angle toward the blade and terminate at a position near such blade. Together, they guide the slabs generally toward the saw blade. Fingers 56 additionally urge the slabs against the end of the fence.

Fingers 56 are mounted on bracket 53 which is connected to frame rail 30 by a vertical pivot rod 55. Relief spring 57 allows the bracket to rotate when the forces on fingers 56 exceed a threshold amount. Fingers 58 are connected to member 66, described below.

Fence 54 is constructed of stiff, vertically spaced-apart horizontal wires 60. The wires are connected rigidly at their ends remote from the blade to a vertical end member 62. They are connected at the opposite end, near the blade, to a second vertical end member 64 by wire brackets 65. The wires are also connected near their middle by wire brackets 66 to a vertical intermediate member 68. Brackets 65, 66 are vertically slidable along members 64, 68 to adjust for unevenness in the surface of the broad face 10*a* engaging the fence. Members 62, 64 and 68 are parallel to the cutting line of blade 14.

Member 68 is pivotally connected at its lower end to frame rail 32 intermediate the end members 62, 64 to define a pivotal connection of the fence to the frame. The portion of the fence extending from the intermediate member 68 to end member 64 is laterally pivotable about member 68, as shown by arrows 67, for laterally deflecting slabs as they progress along the conveyor path. The portion of the fence extending from the intermediate member to end member 62 is also laterally pivotable about the member 68, as shown by arrow 69.

However, movement of member 62 is limited by a retainer 70 connected to frame rail 32. Retainer 70 prevents member 62 from moving into the path of the flights 48 and interfering with their forward movement. Referring to FIG. 1, the retainer includes a vertical tube 72 defining end member 62. Tube 72 has a generally square cross section and a slot extending vertically along one corner on the side opposite the tube's connection with the ends of wires 60. A vertical angle member 74 is connected to frame rail 32. It has an angled portion received within tube 72 and a straight portion extending loosely through the slot to allow lateral movement between the tube and the angle member. The action of retainer 70 is best seen in FIGS. 4 and 5. In one example, a pressure of approximately 10 pounds is required to flex member 62 through lateral range of retainer 70, when member 64 is undeflected laterally.

A deflection means is connected to end member 64 for deflecting the end of fence 54 laterally. The deflection means includes a pivotable rocker arm 76, two parallel push rods 78 and a push rod 84. The rocker arm is connected to a vertical pivot 88, discussed in greater detail hereinafter. Push rods 78 are connected in parallel to the top and bottom of end member 64 by pivot connector 80 and the top and bottom of the end of the rocker arm nearer to blade 14 by pivot 82. Push rod 84 is slidably received in a sleeve 85 and is connected at one end by pivot 86 to the other end of the rocker arm. Sleeve 85 extends horizontally through a hole in the downwardly-extending flange 87 of frame rail 32, and is rigidly connected thereto.

The end of push rod 84 opposite pivot 86 is connected to reciprocating means, such as camming means 90. In FIG. 3 the camming means appears as an annular ring at the periphery of one face of drive sprocket 40. In FIG. 4 it can be seen that the camming means comprises a ramp which is inclined around the circumference of the drive sprocket. At the end of push rod 84 opposite pivot 86 is a roller 83 which contacts the ramp.

As the sprocket turns, the camming means 90 rotates so that push rod 84 is gradually pushed laterally within sleeve 85 toward a position of maximum deflection, as shown in FIG. 5. This action causes the rocker arm to rock, as indicated by arrow 87, causing push rods 78 to deflect end member 64 laterally toward the conveyor path. The distance of such deflection is determined by the proportions of the distances from pivot 88 to pivots 82, 86.

The camming means 90 cooperates with the sprockets 38, 40 and conveyor chain 36 to define synchronization means 22 for synchronizing the deflection of end member 64 with the movement of the flights 48 the slabs 10, along the conveyor path. Sprocket 40 and chain 36 are synchronized so that the saw blade 14 begins cutting the slab at one end face 10*c* in a position laterally offset toward one of the broad faces 10*a* and continues cutting at gradually changing lateral positions until it finishes cutting at the opposite end face 10*c* in a position laterally offset toward the other broad face 10*a*.

Synchronization is obtained by providing that the circumference of the driven sprocket 40 be equal to the distance between flights. Referring to FIG. 4, the chain is positioned around sprocket 40 so that the occurrence of minimum deflection of end member 64 is timed to coincide with the approach of each slab to the blade. Precise positioning of the chain with respect to the camming means must be adjusted experimentally for each machine. However, in general, synchrony is obtained when the cam is positioned for minimum deflection of end member 64, as shown in FIG. 4, by positioning the chain such that the distance from the blade 14 to the front face 50 of the nearest flight 48 in the conveyor path is about one inch more than the length of the slabs.

Thickness Adjustment Assembly

The sensing means 24 and thickness adjustment means 26 cooperate to accommodate the feed system to slabs of varying thicknesses and configurations, as mentioned above.

The sensing means includes a laterally pivotable sensing arm 92 positioned on the opposite side of the conveyor path from the fence. The sensing arm is connected by a vertical pivot member 94 to frame rail 30. The arm has a vertical member 93 at an end position adjacent to intermediate member 66 and connected to pivot 94 by horizontal members 97. Members 97 extend at a lateral angle from pivot 94 toward the conveyor path so that the rollers 96 engage the broad side of each slab, pressing it against the fence. The sensing arm also has a linkage member 95 which extends horizontally beneath frame rail 30 from the bottom of pivot 94 in a direction opposite members 97. Member 95 is connected by pivot 98 to an L-shaped linkage member 100 defining linkage means in the thickness adjustment means. Member 95 has a slot 102 in its end for slidingly receiving pivot 98.

Member 100 has a short arm 101 extending generally parallel to frame rail 30 and a long arm 103 normal to the short arm and extending transversely beneath the conveyor path. Member 100 is connected by a vertical pivot 104 at the corner between arms 101, 103 to frame member 30. Pivot 98 is mounted near the end of arm 101.

The end of the long arm 103, opposite pivot 104, is pivotally connected to shifting means for shifting pivot 88 of the rocker arm longitudinally. The shifing means includes a pull-rod 106 connected by pivot 108 to the end of long arm 103. A simplified version of this connection is shown in FIGS. 4–6 wherein pivot 108 is received in a circular pivot hole in the end of rod 106. FIG. 1 shows the preferred form of this connection, wherein pivot 108 is received in an elongated pivot slot 110 in an L-shaped bracket 112 connected to the end of arm 106.

Slot 110 permits member 100 a limited range of free motion, denoted by arrow 114, before it pullingly engages rod 106. The length of slot 110 determines the maximum thickness of slabs that can be cut without effecting longitudinal movement of pivot 88. For slabs of less than a nominal thickness, such as one inch, sensing arm 92 acts merely as an idler arm, being urged against the broad side of such slabs by a first spring 116. A second spring 118 is connected at one end to the lateral extension 113 of bracket 112 and, at the other end, to a downward extension 120 of the frame. Spring 118 urges pull rod 106 in the direction of the band saw until such spring is overcome by rotation of member 100, as indicated by arrow 115. In one example, sensing arm 92 exerts about 50 pounds of pressure against slabs of one inch thickness.

The end of pull rod 106 opposite pivot 108 is connected to pivot 88. Referring to FIG. 1, pivot 88 is a vertically-elongated rod received in a longitudinally elongated slot 122. The slot is defined by inwardly-opposed, spaced-apart, parallel walls in a pivot box portion 123 of rocker arm 76 and a pivot retainer 125 connected to bracket 132. When pull rod 106 is pulled longitudinally away from the blade by rotation of member 100, pivot 88 moves toward pivot 86. Such movement changes the proportionate distances between pivot 88 and pivots 82, 86 so that the rocker arm rocks through an enlarged angle 87*a*. This action, in turn, proportionately increases the angle through which end member 64 is deflected laterally with respect to the band saw blade, as indicated by arrow 67*a*.

In FIGS. 1 and 3 it can be seen that rod 106 is connected to pivot 88 in a guide structure 124. The guide structure has an outer housing 126 having an internally square cross-section and longitudinal slots 127 in its top and bottom sides. A guide block 128, having an externally square cross-section, is slidingly received in housing 126. A vertical end portion 130 of rod 106 extends through the lower slot (not shown) of housing 126 and is connected to the bottom of block 128. Pivot 88 is connected to the top of the guide block and extends vertically through the upper slot 127 of the housing into slot 122. Housing 126 is rigidly connected to frame rail 32 near the saw table.

Pivot 88 is provided with rollers 134 sized to fit slot 122 to ease longitudinal movement of pivot 88 during operation of the feed system. Two rollers 134 are contained in rocker arm portion 123 and a third roller is contained in retainer 125. Retainer 125 is rigidly connected independently of the rocker arm to bracket 132 and can be removed, as shown in FIG. 1, for servicing the rollers. Bracket 132 is a channel member extending upwardly from frame rail 32, to which it is connected.

Guide structure 124 also includes a set screw 135 to provide means for locking pivot 88 in a selected position to produce tapered shingles of a specifiable uniform thickness. Locking pivot 88 and disconnecting the sensing means from the rocker arm pivot shifting means by disconnecting pull rod 106 enables the system to be used for sawing multiple tapered shingles from either slabs or blocks of wood that are too thick for resawing into just two shingles.

Drag Wheel Conveyor Assembly

The outfeed conveyor means 28 is positioned in the conveyor path downstream of the band saw blade 14. Referring to FIG. 3, a gear housing 136 is attached to frame extension 120 for housing shaft 138 upon which the driven sprocket 40 rotates. Connected to shaft 138 is a gear 140 meshed with a gear 142. Gear 142 is drivably connected to the outfeed conveyor means via an extensible drive line 144 and U-joints 146, 148.

Referring to FIGS. 1 and 2, the outfeed conveyor means is preferably a drag wheel conveyor having two wheels 150, 152 mounted for horizontal rotation with their treads 154, 156 inwardly opposed and contacting at a position in the conveyor path. The wheels are independently mounted on vertical axles 158, 160, respectively. Axle 160 is rotated by shaft 144 through gears 162, 164 contained in a laterally movable gear housing 166.

The wheels have their axles mounted on a sleeved housing 168. Housing 168 is welded or rigidly bolted to the band saw table 16. Housing 168 is adapted for permitting the wheels to move laterally together as a unit, and to move apart independently, when so urged by a pair of shingles passing between their treads. Housing 168 includes an outer housing portion 170, an intermediate housing 172 contained within portion 170, and an inner housing portion 174 contained within intermediate housing portion 172. The outer housing portion has two laterally extending slots 176, 178 along its upper side, the axles extending upwardly therethrough. The outer housing also has a slot 180 along its lower side through which axle 160 extends downwardly. Wheel 152 is connected to the intermediate housing by bearing journals 182, 184 which protrude through slots 178, 180. Intermediate housing 172 has a slot 186 along its upper side which substantially parallels slot 176. Axle 158 is received in a tubular sleeve 188 which is connected to the inner housing portion and extends through slots 176, 186.

The intermediate and inner housing portions 172, 174 each have a lateral end wall 190, 192, respectively. A spring 194 extends between such walls to urge portion 174 and wheel 150 toward wheel 152. Contact is thereby maintained between treads 154 and 156 so that rotation of wheel 152 causes wheel 150 to also rotate. The size of the wheels and the gears involved in rotating the wheels are proportioned so that the angular velocity of the treads of the wheels (arrows 196) is slightly greater than the forward speed of the infeed conveyor.

Behind the tires is a shingle sorting apparatus (not shown) comprising two side-by-side receptacles or bins for receiving the sawn shingles and a solenoid-actuated deflector for sorting the shingles by thickness. The deflector is pivotally mounted along the cutting line of the saw for rotating left and right under the control of a solenoid. The solenoid is actuated by a switch connected to sensing arm 92.

OPERATION OF THE INVENTION

Referring to FIGS. 1, 4 and 5, a shake slab 10 is manually or mechanically placed in the conveyor path with one of its broad faces **10*a* contacting back plate 52 and an end face directed toward the saw blade. Operating the motor 46 causes the conveyor means 18 to circulate along the conveyor path toward the saw blade 14, the flights 48 being borne along by the conveyor chain 36. Movement of the chain rotates driven sprocket 40. When the flight circulates upwardly onto the conveyor path its front face 50 engages the trailing end face 10*c* of the slab and begins pushing the slab toward the saw blade, as indicated by arrow 11**.

At this point push rod 84 is at the lowest position on the ramp of camming means 90. In FIGS. 4 and 5 slab 10 is within a nominally "normal" thickness range, for example, about one inch thick. Therefore, sensing arm 92 is laterally undeflected and pivot 88 is in a forward position in slot 122. Consequently, end member 64 is likewise undeflected laterally and the fence 54 defines a generally straight line as the leading end face of the slab approaches the blade.

This is to be contrasted with the operation shown in FIG. 6 in which a thick slab 10' or a curved slab 10'' (FIG. 7) causes the sensing arm to be deflected laterally, as indicated by arrow 198. Such deflection causes the sensing arm to rotate about pivot 94, causing arms 95, 101 to rotate about pivot 98 toward the conveyor path, as indicated by arrows 200. This movement causes member 100 to rotate about pivot 104 so that arm 103 rotates longitudinally against the tension of spring 118, moving pull-rod 106 away from the blade, as indicated by arrow 202. Thus, pivot 88 is moved toward pivot 86 so that the rocker arm 76 deflects end 64 of the fence 54 laterally away from the saw blade (arrow **87*a*) flexing the wires of the fence against the restraint of retainer 70 (arrow 69 in FIG. 1**).

Referring to FIG. 5, the slab continues to be carried forward into the saw by the conveyor. As the conveyor moves forward, the driven sprocket 40 rotates to bring progressively elevated portions of the camming means 90 into contact with the roller 83 of push rod 84, thereby moving the push rod laterally. This action causes the rocker arm to deflect end 64 of the fence laterally toward the blade 14. Such deflection progressively shifts the slab laterally so that the blade cuts along a diagonal line through the slab.

Two similarly tapered resawn shakes or shingles are thereby produced. It should be noted that this result is obtained for thick slabs 10' as well as thin slabs 10, as a result of the thickness adjustment operation described above with reference to FIG. 6. It should be also noted that a similar result is obtained with slabs 10'', which can be longitudinally curved, warped, or of varying thickness. Such anomalies would be manifested by a lateral movement of the sensing arm, causing the fence to be deflected laterally to compensate.

For example, in FIG. 7, slab 10'' is normal in the regions of numerals 210, 218, bowed outward from fence 54, in the region of numeral 212, and varies in thickness along its length, as indicated at 214. Initially, such a slab would be sensed as having a normal thickness in region 210. However, as the slab progresses along the conveyor the bulges in regions 212, 214 would cause the fence 54 to flex laterally in the region of end member 62 in the direction of arrow 220. Simultaneously, such bulges would be detected and transmitted through linkage means 26 to pivot 88, causing such pivot to move longitudinally away from the saw blade and, in turn, causing end member 64 of the fence to be repositioned laterally as described above with reference to FIG. 6. Thereafter, as the bulge of region 214 subsides, the sensing arm would move laterally in the opposite direction, toward the fence, allowing the fence to straighten and allowing spring 118 to urge pivot 88 longitudinally toward the saw blade. The fence would be caused to move laterally relative to the saw blade in response to the pressure of the slab against arm 92 and fence 54 to produce a curved diagonal cut 222 through the slab which generally conforms to the contours of the slab's broad faces.

Pressure of rollers 96 and fence 54 in the region of intermediate member 68 urges the portion of the slab pressed therebetween toward a position parallel to the cutting line of the blade. Thus, if slab 10'' is also twisted lengthwise, cut 222 will likewise be twisted lengthwise.

Referring to FIG. 5, when the slab has been pushed through the saw blade to a point where it has been nearly cut through, it ceases to be pushed by flight 48. At about the same time the leading end of the slab is engaged by drag wheels 150, 152 of the outfeed conveyor means 28. As the slab is pushed laterally by the deflection means, the drag wheels slide laterally with it. Just as the flight is preparing to rotate around the driven sprocket 40 downward out of the conveyor path, the now-sawn leading end of the slab moves into the region between the treads of the two tires. The tires, urged together by spring 194 and rotating slightly faster than the conveyor chain 36 is moving, engage the leading end of the slab between treads 152, 154 and pull it the rest of the way through the saw blade. The slab is expelled on the opposite sides of the tires as two resawn tapered shakes or shingles.

Such shakes or shingles are received by the aforementioned shingle sorting apparatus (not shown). If the shakes or shingles are of normal thickness, they are allowed to drop into one bin. If they are overly thick or curved, the sensing arm turns the switch on, causing the solenoid to move the deflector into position for deflecting such shingles into the other bin.

Having illustrated and described a preferred embodiment of the invention, it should be apparent to those skilled in the art that the invention may be modified in arrangement, application and detail. I claim as my invention all such modifications as come within the true spirit and scope of the following claims.

I claim:

1. A shake resaw feed system for use with a band saw for sawing tapered shake shingles from slabs, said system comprising:

conveyor means for conveying a slab lengthwise toward and through the blade of said saw; and guide means for positioning said slab for cutting said slab lengthwise along a cutting line between its broad faces;

said guide means including wall means extending lengthwise along the conveyor means and said wall means being immobile relative to the conveyor means in a lengthwise direction, a portion of the wall means being laterally movable for progressively shifting said slab laterally of said conveyor means so that the blade begins cutting at an end face of said slab at a lateral position near one of said broad faces and finishes cutting at the opposite end face at a lateral position near the opposite broad face.

2. Apparatus according to claim 1, including:

sensing means for sensing the contours of a broad face of a slab positioned on said conveyor means for cutting; and thickness adjustment means responsive to said sensing means to control the guide means for automatically repositioning said slab laterally of said conveyor means to compensate for variations in the contours of the broad face of said slab.

3. Apparatus according to claim 1 including infeed conveyor means for conveying slabs toward and a portion of the way through said saw and outfeed conveyor means for pulling said slabs through the saw;

said outfeed conveyor means including adjusting means responsive to the lateral position of said slabs for adjusting said outfeed conveyor means laterally of said blade to receive shingles cut from slabs passing through the saw in varied lateral positions.

4. Apparatus according to claim 3, in which said outfeed conveyor means includes:

two counter-rotating wheels mounted side-by-side and having inwardly-opposed treads;

spring means urging said wheels together for pinching shingles between their treads;

means for mounting said wheels such that said two wheels can slide laterally as a unit when contacted by a slab which is not centered therebetween; and drive means connected to at least one of said wheels for rotating said wheels at an angular velocity exceeding the velocity of said infeed conveyor means;

whereby the wheels can receive shingles of a partially sawn slab between their treads to pull the remainder of said slab through said saw.

5. Apparatus according to claim 1 in which said wall means has an end near said blade which is laterally movable to progressively shift said slab.

6. A shake resaw feed system for use with a band saw for sawing tapered shake shingles from slabs, said system comprising:

conveyor means for conveying a slab lengthwise toward and through the blade of said saw; and guide means for positioning said slab for cutting said slab lengthwise along a cutting line between its broad faces;

said guide means being operable to progressively shift said slab laterally of said conveyor means so that the blade begins cutting at an end face of said slab at a lateral position near one of said broad faces and finishes cutting at the opposite end face at a lateral position near the opposite broad face;

said guide means including wall means extending lengthwise along said conveyor means, a portion of said wall means having an end near said blade which is laterally movable;

said wall means comprising a fence along one side of said conveyor means, said fence having:

multiple flexible, vertically spaced-apart, generally parallel wire members extending lengthwise along said conveyor means; and an end member parallel to said blade connecting said wire members together at an end of said fence;

said end member being laterally movable for shifting said slab laterally.

7. Apparatus according to claim 6 in which said fence includes two end members and an intermediate member between and parallel to said end members;

said intermediate member being pivotably connected to the support structure of said conveyor means;

the end member nearer to the blade being laterally movable.

8. Apparatus according to claim 6 in which said wall means includes flexible wall means for urging said slab against said fence.

9. Apparatus according to claim 8 in which said flexible wall means includes multiple parallel spaced-apart flexible fingers opposite said laterally movable end member.

10. Apparatus according to claim 6 in which said guide means includes deflection means for progressively deflecting the end member laterally as a slab is being conveyed through said saw.

11. Apparatus according to claim 10 in which said deflection means includes reciprocating means drivably connected to said conveyor means for deflecting the end member laterally.

12. A shake resaw feed system for use with a band saw for sawing tapered shake shingles from slabs, said system comprising:

conveyor means for conveying a slab lengthwise toward and through the blade of said saw; and guide means for positioning said slab for cutting said slab lengthwise along a cutting line between its broad faces;

said guide means being operable to progressively shift said slab laterally of said conveyor means so that the blade begins cutting at an end face of said slab at a lateral position near one of said broad faces and finishes cutting at the opposite end face at a lateral position near the opposite broad face;

said guide means including wall means extending lengthwise along said conveyor means, a portion of said wall means having an end near said blade which is laterally movable;

said guide means including deflection means for progressively deflecting the end of said portion laterally as a slab is being conveyed through said saw;

said deflection means including reciprocating means drivably connected to said conveyor means for deflecting the end of said portion laterally;

said conveyor means including an endless conveyor chain circulating along an infeed conveyor path forming a small lateral angle with the saw line of said blade, and pushing means connecting to said chain for pushing slabs toward said blade as said chain circulates, said guide means includes flexible wall means on the opposite side of the conveyor path from the fence for urging slabs laterally against the end of the fence; and said deflection means includes reciprocating means driven by said driving means for deflecting the end of said portion laterally;

said reciprocating means including a pivotable rocker arm having one end connected to said reciprocating means and the other end being connected to said laterally movable portion;

said reciprocation means being operable to minimally deflect the end of said portion laterally when said pushing means is a distance from said blade such that the slab approaches but does not yet contact the blade, and to maximally deflect said end when the pushing means is near the blade, whereby said slab is sawn lengthwise along a generally diagonal cutting line.

13. Apparatus according to claim 12, including:

sensing means for sensing variable contours of said slab; and thickness adjustment means responsive to said sensing means and controlling said deflection means for automatically repositioning said portion of said wall means laterally of said blade;

whereby said slab is laterally repositioned to compensate for said variable contours.

14. Apparatus according to claim 13 in which said reciprocation means includes a camming means connected to the drive means of said conveyor chain;

said camming means including a push rod connected to one end of said rocker arm and slidingly contacting a camming surface in said camming means.

15. Apparatus according to claim 14 in which said thickness adjustment means includes shifting means for shifting the pivotal connection of said rocker arm among longitudinal positions between the ends of said arm.

16. Apparatus according to claim 15 in which said rocker arm includes a lengthwise slot for containing a pivot;

said pivot being movable within said slot toward the ends of the rocker arm.

17. Apparatus according to claim 16 in which said sensing means includes a laterally pivotable sensing arm positioned for contacting the broad side of said slab opposite said wall means and said shifting means includes linkage means for translating the lateral motion of said sensing arm into a longitudinal shift in the position of said pivot;

whereby the range of deflection of said deflection means is automatically changed in response to the distance of said broad side from said wall means.

18. In a conveyor and sawing system for cutting elongated members of variable lateral contours along their length as said members travel along an infeed conveyor path, apparatus for tapered cutting of said members to produce two longitudinally tapered portions from each member, said apparatus comprising:

guide means extending along a side of the conveyor and having a longitudinally immobile wall portion adapted for slidingly contacting a lateral side of said members, said portion having a laterally movable free end near the cutting blade of said system and a fixed intermediate point pivotably connected to the frame of said conveyor;

deflection means for progressively deflecting the free end of said portion laterally to shift said members laterally as they travel along said conveyor path so that cutting begins at one end of such a member at a position laterally offset toward one lateral side of the member and concludes at the opposite end of the member at a position laterally offset toward the opposite lateral side of said member;

sensing means for sensing the lateral contours of said member; and thickness adjustment means responsive to said sensing means for controlling said deflection means to automatically reposition said members laterally to compensate for variations in their lateral contours.

19. In a conveyor and sawing system for cutting elongated members of variable lateral contours along their length as said members travel along an infeed conveyor path, said conveyor having an endless conveyor chain circulating in said conveyor path and flight means connected at intervals along said chain for receiving said members for movement therewith, apparatus for tapered cutting of said members to produce two longitudinally tapered portions from each member, said apparatus comprising:

guide means extending along a side of the conveyor and having a wall portion adapted for slidingly contacting a lateral side of said members, said portion having a laterally movable free end near the cutting blade of said system and a fixed intermediate point pivotably connected to the frame of said conveyor;

deflection means for progressively deflecting the free end of said portion laterally to shift said members laterally as they travel along said conveyor path so that cutting begins at one end of such a member at a position laterally offset toward one lateral side of the member and concludes at the opposite end of the member at a position laterally offset toward the opposite lateral side of said member;

sensing means for sensing the lateral contours of said member; and thickness adjustment means responsive to said sensing means for controlling said deflection means to automatically reposition said members laterally to compensate for variations in their lateral contours;

said deflection means including reciprocation means rotationally connected to said conveyor chain and a rocker arm on a longitudinally shiftable pivot and having a first end connected to the free end of said wall portions and a second end connected to said reciprocation means;

said sensing means including a laterally pivotable sensing arm positioned for contacting the lateral side of said members opposite the fixed intermediate point of said wall portion; and said thickness adjustment means including shifting means responsive to the lateral position of said sensing arm for shifting said pivot;

said rocker arm having a longitudinally extending slot for slidably receiving said pivot.

20. Apparatus according to claim 19 in which said reciprocation means includes:

a wheel rotating in a plane parallel to said path, said wheel having a beveled annular camming surface on one side face; and a push rod slidingly contacting said surface at one end and connected to the rocker arm at the other end;

said surface being adapted for gradually pushing said push rod laterally as said wheel turns from a position of minimum deflection to a position of maximum deflection and for allowing said push rod to return to said position of minimum deflection to define one camming cycle;

said wheel being geared to said conveyor chain so that said push rod returns to said position of minimum deflection at the conclusion of cutting of each of said members.

* * * * *